US006974370B2

(12) United States Patent
Hutchins

(10) Patent No.: US 6,974,370 B2
(45) Date of Patent: Dec. 13, 2005

(54) SPINDLE LOCK FOR AN ORBITAL ABRADING OR POLISHING TOOL

(75) Inventor: Donald H. Hutchins, Sierra Madre, CA (US)

(73) Assignee: Hutchins Manufacturing Company, Pasadena, CA (US)

( * ) Notice: Subject to any disclaimer, the term of this patent is extended or adjusted under 35 U.S.C. 154(b) by 18 days.

(21) Appl. No.: 10/846,042

(22) Filed: May 14, 2004

(65) Prior Publication Data

US 2004/0229555 A1 Nov. 18, 2004

Related U.S. Application Data

(60) Provisional application No. 60/471,074, filed on May 16, 2003.

(51) Int. Cl.[7] ..... B24B 23/00
(52) U.S. Cl. ..... 451/357; 451/344; 451/353
(58) Field of Search ..... 451/357, 356, 451/358, 359, 344, 340, 350, 353, 354; 15/19.1, 15/98; 30/166.3, 388, 478

(56) References Cited

U.S. PATENT DOCUMENTS 4,434,587 A 3/1984 McDougall
4,660,329 A * 4/1987 Hutchins ..... 451/357
4,854,085 A 8/1989 Huber
4,924,633 A 5/1990 Hock et al.
4,924,636 A * 5/1990 Hoffman ..... 451/357
5,319,888 A 6/1994 Huber et al.
5,347,673 A * 9/1994 Nickels, Jr. ..... 15/97.1
5,392,568 A 2/1995 Howard, Jr. et al.
5,411,386 A 5/1995 Huber et al.
5,580,302 A 12/1996 Howard, Jr. et al.
5,582,541 A * 12/1996 Hutchins ..... 451/357
5,595,530 A 1/1997 Heidelberger
5,823,862 A 10/1998 Heidelberger
6,007,412 A * 12/1999 Hutchins ..... 451/295
6,190,245 B1 2/2001 Heidelberger et al.
6,485,360 B1 * 11/2002 Hutchins ..... 451/357

* cited by examiner

*Primary Examiner*—Dung Van Nguyen
(74) *Attorney, Agent, or Firm*—Christie, Parker & Hale, LLP

(57) ABSTRACT

An orbital abrading or polishing tool is provided that includes a tool body to be held and manipulated by a user. A motor is carried by the tool body and has a motor shaft driven for rotation about a primary axis. The motor shaft has a cylindrical portion at one end. A spindle is received within the cylindrical portion of the motor shaft for rotation about a secondary axis offset from and parallel to the primary axis. The cylindrical portion of the motor shaft has an opening extending inwardly to the spindle and a locking element is extendable through the motor shaft opening to engage the spindle in a locking relationship.

15 Claims, 5 Drawing Sheets

SPINDLE LOCK FOR AN ORBITAL ABRADING OR POLISHING TOOL

CROSS-REFERENCE TO RELATED APPLICATION(S)

The present application claims priority to U.S. Provisional Application No. 60/471,074, filed May 16, 2003, the contents of which are expressly incorporated by reference as though set forth in full.

FIELD OF THE INVENTION

This invention relates to an improved apparatus and method that facilitates replacing an abrading or polishing head on an orbital abrading or polishing tool, and more particularly, to a spindle lock that prevents a rotational movement of a spindle during a replacement of an abrading or polishing head on such a tool.

BACKGROUND OF THE INVENTION

Orbital abrading or polishing tools have been available for many years. Examples of such tools are presented in U.S. Pat. Nos. 4,592,170; 4,660,329; 4,671,019; 4,839,995; 4,986,036; 5,445,558; 5,597,348; and 6,485,360 each to Hutchins and all of which are incorporated by reference in their entirety into the present disclosure.

Orbital sanding tools of the prior art have, in some instances, been shaped to be held by a user in manipulating the tool and moving it along a horizontal work surface to sand the work surface. Such sanders often utilize a head which carries a sheet of sandpaper and is driven rotationally by a compressed air powered motor. The motor is usually contained within a rather heavy body structure.

Typically, the head is mounted to a spindle which in turn is mounted eccentrically relative to the vertical axis of the motor so that the head orbits about the vertical axis. It is often desirable to be able to quickly and easily remove the head from the drive portion of the sander in order to enable interchangeable use of any of several heads of different sizes and shapes with the same drive unit. A drive unit and a set of different heads can then perform, in effect, as a number of different tools. In the prior art, replacing the head has been relatively difficult because tools have typically been required for unscrewing the head from the drive portion of the orbital sander.

Previously developed portable orbital sanders have utilized a flexible shroud to provide access for insertion of a tool between the head and the housing to lock the spindle so that the head can be unscrewed manually from it. Located within the shroud and just above the spindle is a rotating counterweight used to counterbalance the eccentrically mounted spindle and head. This arrangement has several disadvantages, however. First, the flexible shroud can be pressed inwardly by an operator's fingers until it contacts the rotating counterweight. This causes wear to the sander in addition to unwanted vibrations. Also, debris can enter the space between the shroud and the head, and thus clog the inner workings of the sander, if the flexible shroud becomes distorted. Further, there is a risk that the fingers of the operator might enter the space, causing injury to the user.

Another structure for locking the spindle of an orbital tool to facilitate replacement of an abrading or polishing head is disclosed in U.S. Pat. No. 6,485,360. The structure of the '360 patent has a push button actuable to engage a notch in the circumference of the spindle in a locking relationship.

Such a structure is difficult to incorporate in a tool with a small spindle diameter, however.

SUMMARY OF THE INVENTION

In one embodiment, the present invention is an orbital abrading or polishing tool that includes a tool body to be held and manipulated by a user. A motor is carried by the tool body and has a motor shaft driven for rotation about a primary axis. The motor shaft has a cylindrical portion at one end. A spindle is received within the cylindrical portion of the motor shaft for rotation about a secondary axis offset from and parallel to the primary axis. The cylindrical portion of the motor shaft has an opening extending inwardly to the spindle and a locking element is extendable through the motor shaft opening to engage the spindle in a locking relationship.

In another embodiment, the present invention is an orbital abrading or polishing tool that includes a tool body having a shroud, wherein the tool body is to be held and manipulated by a user. A motor is carried by the tool body and has a motor shaft driven for rotation about a primary axis. The motor shaft has a cylindrical portion at one end. A spindle is received within the cylindrical portion of the motor shaft for rotation about a secondary axis offset from and parallel to the primary axis and driven in an orbital path about the primary axis when the motor turns the motor shaft. A head is threadedly connected to the spindle and is adapted to carry an element for abrading or polishing a work surface. The cylindrical portion of the motor shaft has an opening extending inwardly to the spindle and a locking element is extendable through the motor shaft opening to engage the spindle in a locking relationship.

In yet another embodiment, the present invention is a method for replacing a head of an orbital abrading or polishing tool that includes providing a motor that drives a motor shaft, wherein the motor shaft receives a spindle, pressing on a locking element to contact the motor shaft, manually rotating a first head that is threadedly connected to the spindle until the locking element enters an opening in the motor shaft that extends inwardly to the spindle, pressing on the locking element to contact the spindle to lock the spindle against rotation, and manually rotating the first head while the spindle is locked against rotation until the first head is disengaged from the spindle. The method further includes positioning a second head relative to the spindle so that the second head can be rotated relative to the spindle to form a threaded connection therebetween, manually rotating the second head to threadedly and tightly connect the second head with the spindle, and releasing the locking member to disengage the locking member from the both the spindle and the motor shaft opening to thereby allow the spindle and motor shaft to freely rotate.

BRIEF DESCRIPTION OF THE DRAWINGS

In the drawings, which constitute part of this specification, embodiments demonstrating various features of the invention are set forth as follows.

DETAILED DESCRIPTION OF THE PREFERRED EMBODIMENTS

Figure 1:
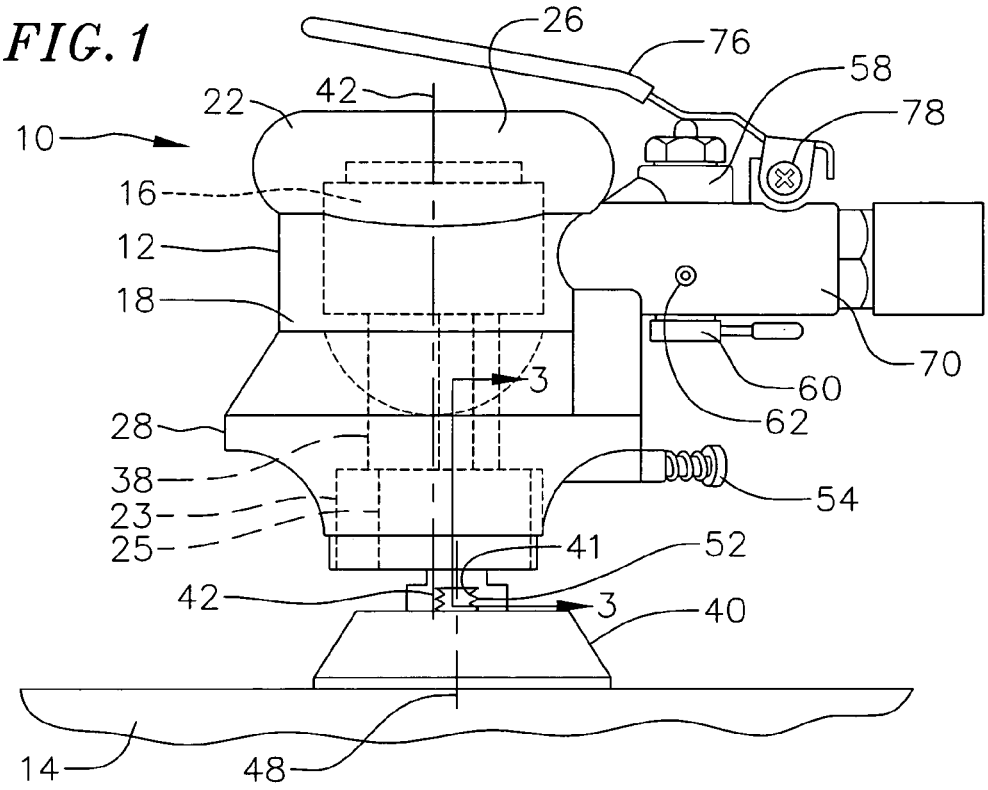
FIG. 1 is a side elevational view of a disclosed embodiment of an orbital sanding tool constructed according to the present invention showing a motor shaft and a spindle in dashed lines.

Although detailed illustrative embodiments are disclosed herein, other suitable structures and machines for practicing the invention may be employed and will be apparent to persons of ordinary skill in the art. Consequently, specific structural and functional details disclosed herein are representative only, that is, they merely describe exemplary embodiments of the invention.

Generally speaking, as shown in FIGS. 1–7, embodiments of the present invention are directed to an orbital abrading or polishing tool 10. The tool 10 includes a body structure 12 to be held and manipulated by a user. The body structure 12 carries an air driven motor 16 having a motor shaft 38 driven for rotation about a primary axis 42. A cylindrical portion of the motor shaft 38 receives a spindle 25 for rotation about a secondary axis 48 offset from and parallel to the primary axis 42. The motor shaft 38 has a passageway 71 that extends inwardly to the spindle 25. A plunger 54 is extendable through the passageway 71 to engage the spindle 25 in a locking relationship to prevent a rotation of the spindle 25, thus enabling a head or pad 40 that is screw fastened to the spindle 25 to be disengaged from the spindle 25 and replaced by a second head.

Figure 4:
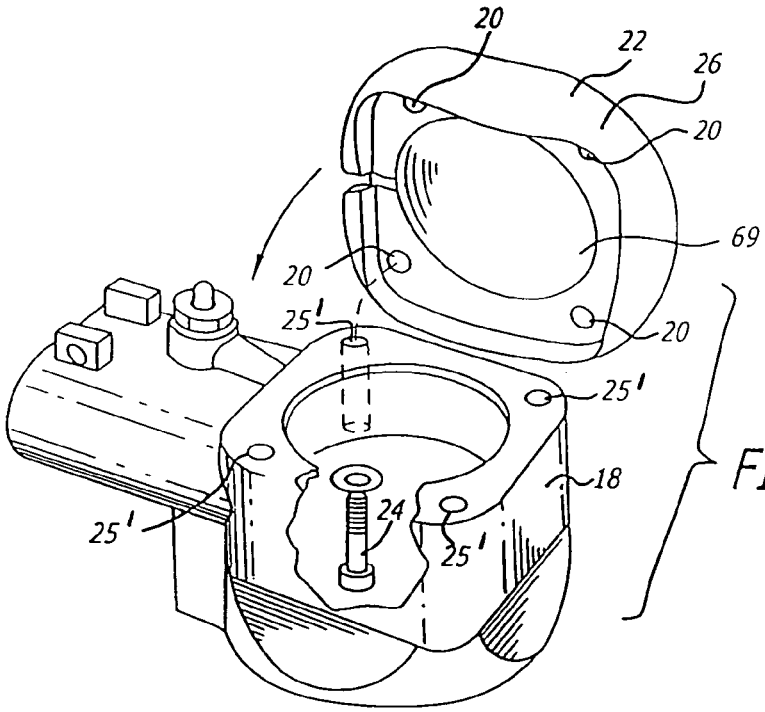
FIG. 4 is an exploded perspective view of the body structure of the sanding tool of FIG. 1, showing how the top cover is secured to the main body section using lugs secured to a reinforcing plate embedded within the top cover.
Figure 5:
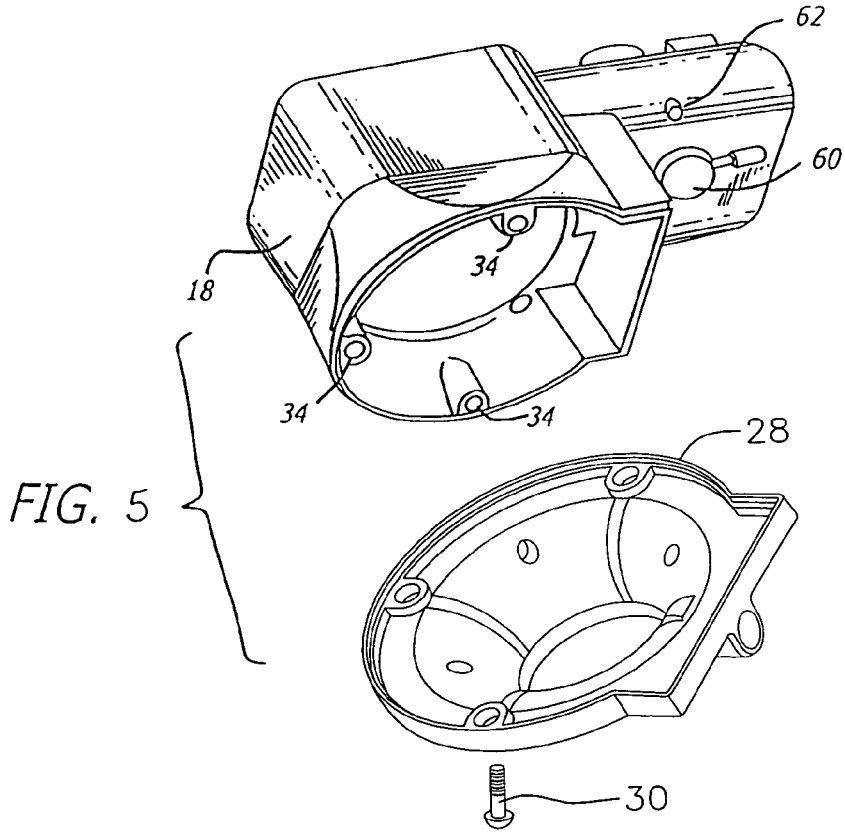
FIG. 5 is an exploded perspective view of the body structure showing how the shroud is secured to the main body section using three screws.
Figure 6:
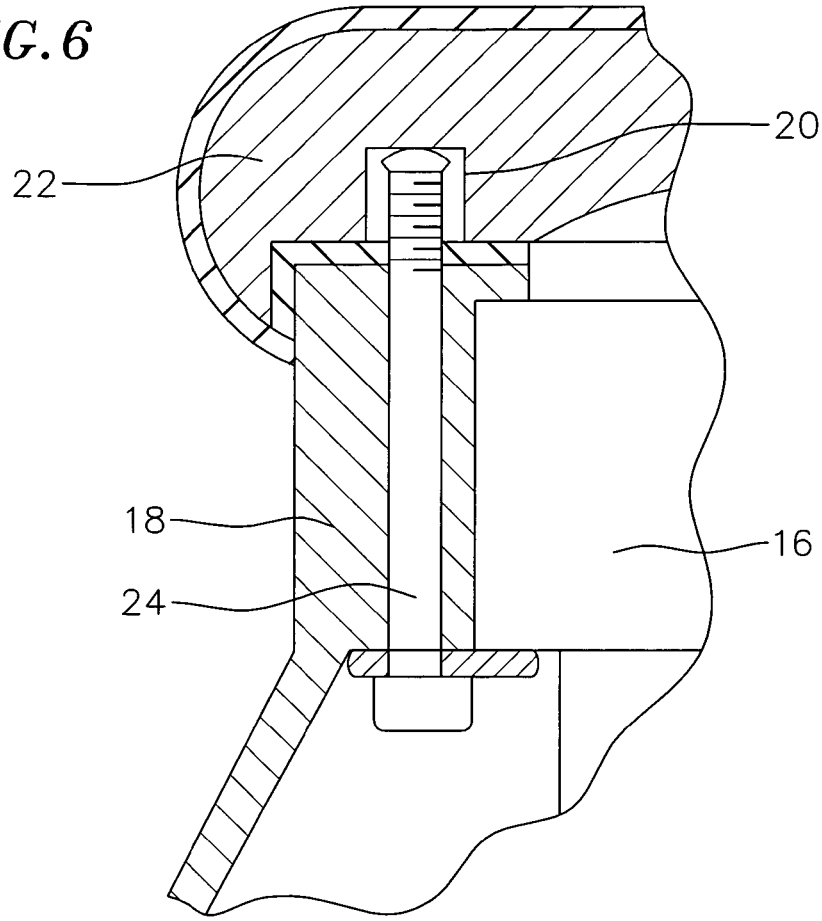
FIG. 6 is a fragmentary vertical cross-sectional view of the orbital sanding tool showing a screw passing through the main body section to secure the top cover utilizing a lug embedded in the top cover.

In the embodiment of FIG. 1, the tool 10 includes the injection molded body structure 12 which is shaped externally to facilitate being grasped and manipulated by a user when moved along a work surface 14 to sand the surface 14. The air driven motor 16 is contained within a main body section 18 of the body structure 12 (FIG. 1). Four lugs 20 are embedded in a top cover 22 of the body structure 12 (FIGS. 4 and 6). The top cover 22 is secured to the main body section 18 by screws 24 passed upwardly through holes 25' in the top of the main body section 18 and fastened to the lugs 20. The top cover 22 is preferably covered by a cushion 26 of rubber, plastic or other resilient material by which the sander is held. The lower portion of the body structure 12 is made up of a skirt or shroud 28 that is attached to the main body section 18, as shown for example in FIG. 5. In the embodiment of FIG. 5, the shroud 28 is held in place by three screws 30 extending upwardly through holes 32 in the shroud 28 and into tapped bores 34 in the main body section 18.

Figure 3A:
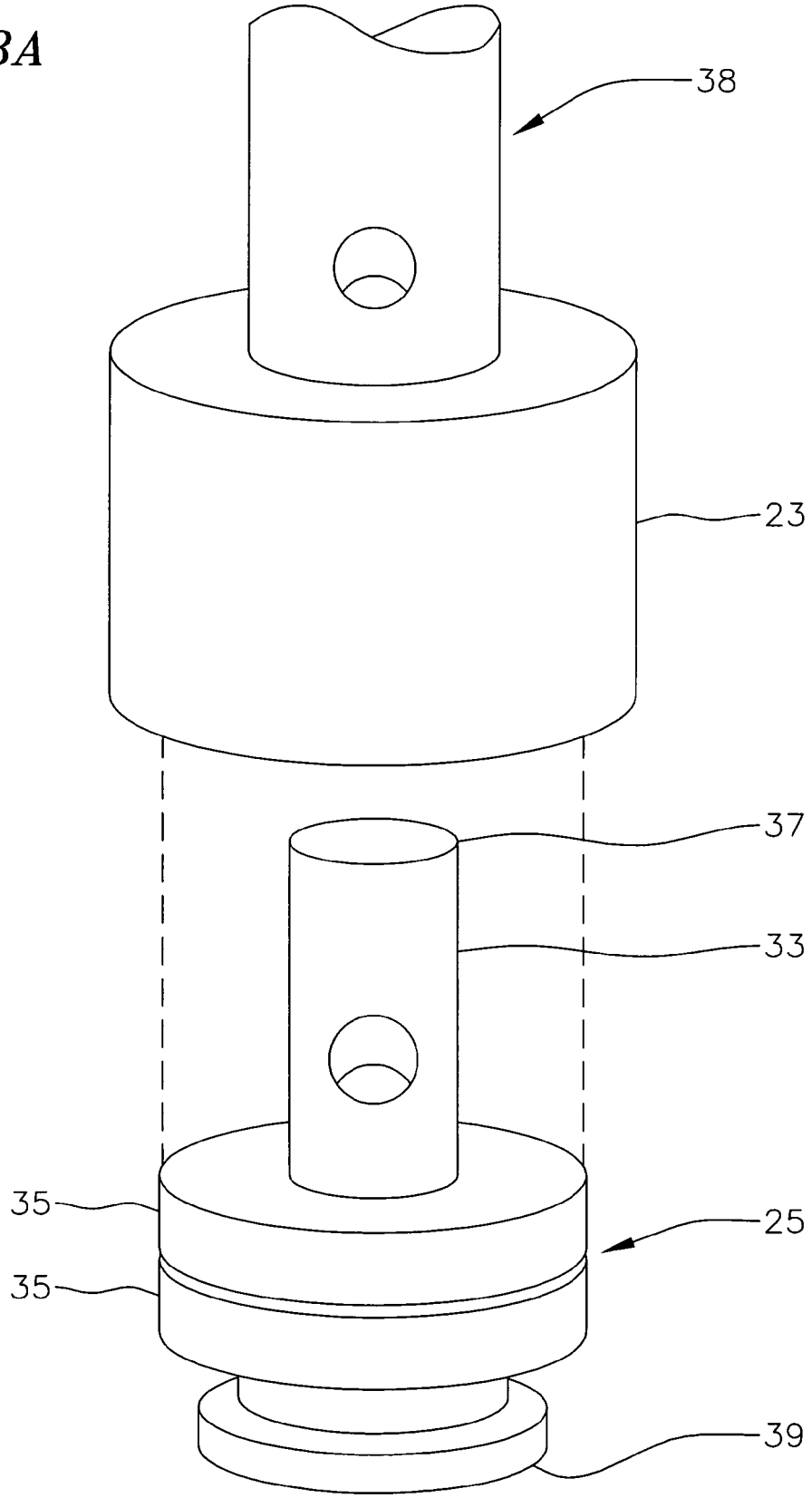
FIG. 3A is perspective view the motor shaft and the spindle of FIG. 1.
Figure 3B:
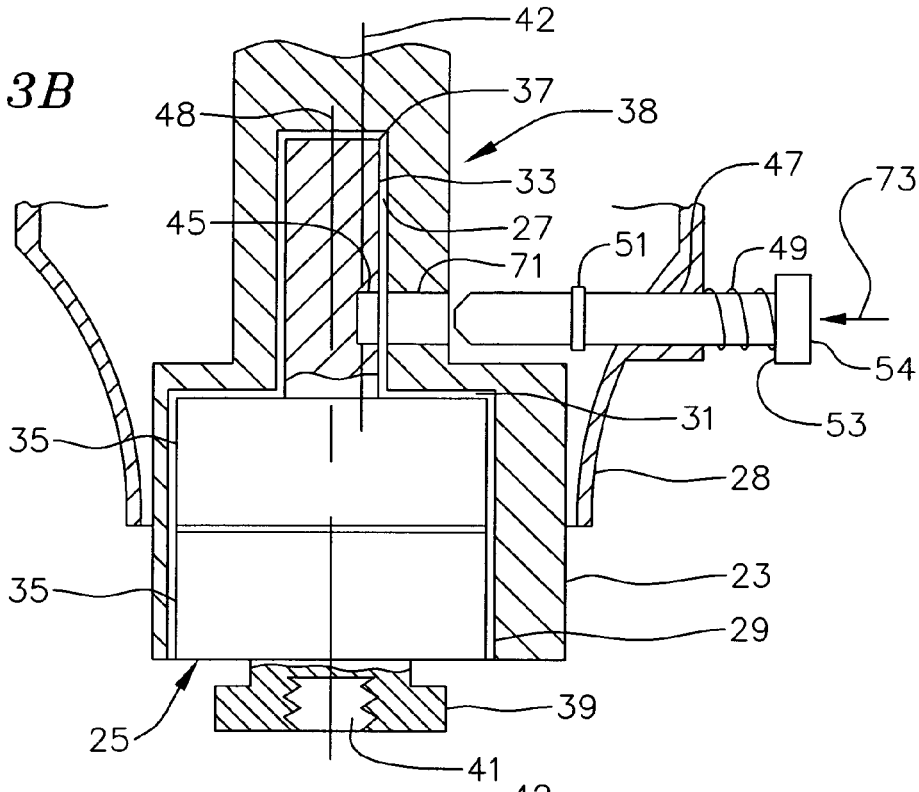
FIG. 3B is a vertical cross-sectional view of the orbital sanding tool taken along the line 3—3 of FIG. 1 showing a locking element in an unlocked position with the spindle shown in partial cross section.
Figure 3C:
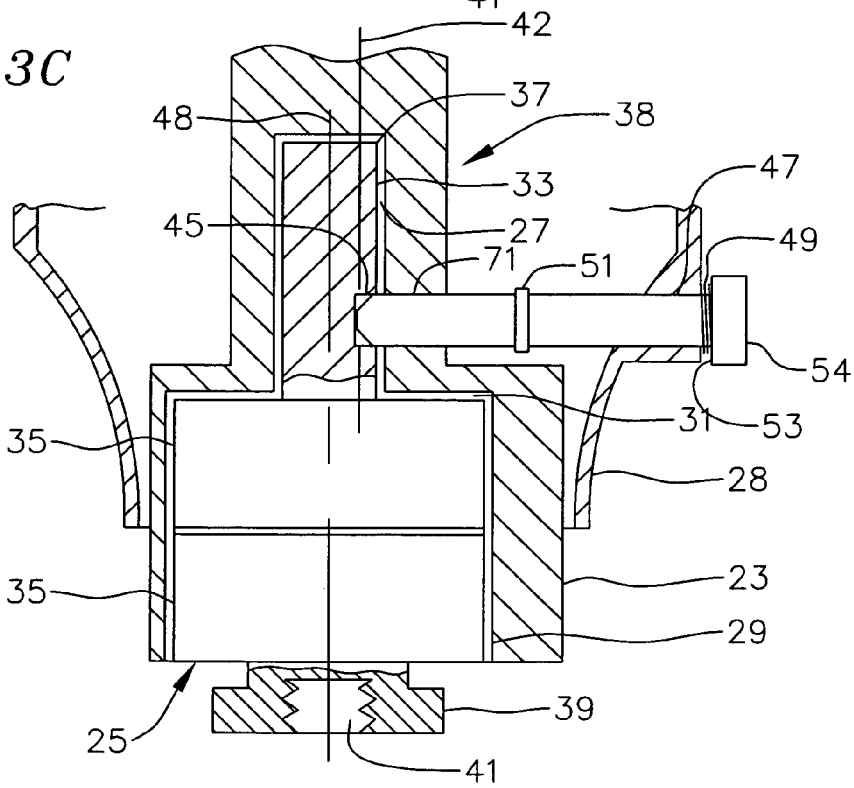
FIG. 3C is a vertical cross-sectional view of the orbital sanding tool taken along the line 3—3 of FIG. 1 showing a locking element in a locked position with the spindle shown in partial cross section.

As shown in FIG. 1, the air driven motor 16 of the tool 10 is attached to the motor shaft 38, such that when the motor 16 is activated, the motor 16 rotates the motor shaft 38 about the motor shaft primary axis 42. FIGS. 3A–3C show one embodiment of the motor shaft 38. In this embodiment, the motor shaft 38 is generally cylindrical in shape and has a second end 23 that receives the spindle 25. The motor shaft 38 defines an opening 31 (FIGS. 3B and 3C) that is eccentric to the outer diameter of the motor shaft 38, such that the central axis of the motor shaft opening 31 has the secondary axis 48 that is parallel to the primary axis 42 but slightly offset therefrom in a lateral direction.

In one embodiment, the motor shaft 38 has an outwardly stepped cylindrical surface and the motor shaft opening 31 includes an enlarged outer portion 29 and a reduced diameter inner portion 27.

FIGS. 3A–3C also show one embodiment of the spindle 25. In this embodiment, the spindle 25 includes a cylindrical spindle shaft 33 and one or more bearings 35 mounted to the spindle shaft 33. In addition, the bearings 35 are rotatably mounted on the spindle shaft 33 and independently moveable thereabout. The spindle shaft 33 may also include an upper snap ring and a lower snap ring (not shown) for preventing longitudinal movement of the bearings 35 with respect to the spindle shaft 33.

As shown in FIGS. 3B and 3C, a first end 37 of the spindle shaft 33 fits snugly within the inner portion 27 of the motor shaft opening 31 and the bearings 35 of the spindle 25 fit snugly within the outer portion 29 of the motor shaft opening 31. When so positioned, the central axis of the spindle 25 is aligned with the secondary axis 48, such that when the spindle 25 is rotated within the motor shaft opening 31, the spindle 25 is rotated about the secondary axis 48.

A second end 39 of the spindle shaft 33 defines an internally threaded bore 41 disposed along the central axis of the spindle shaft 33 and hence aligned with the secondary axis 48. The threaded bore 41 threadably engages an externally threaded stud 52 that extends from the central axis of the head 40, enabling the head 40 to be removably fastened to the spindle 25. In this arrangement, the central axis of the head 40 is aligned with the secondary axis 48. As such, activation of the motor 16 causes the motor shaft 38 to rotate the head 40 orbitally about the primary axis 42 of the motor shaft 38, while allowing the head 40 to rotate concentrically about the secondary axis 48.

The head 40 may have an abrasive material on an outer surface thereof. For example, in one embodiment, a sheet (not shown) having an adhesive on one side thereof and an abrasive material on an opposite side thereof is attached to the head 40. In such an embodiment, the abrasive sheet is easily removable and replaceable when the abrasive material wears down.

As shown in FIGS. 3B and 3C, the body 12 of the tool 10 defines a passage 47 that receives the plunger 54. The spindle 25 can be locked against rotational motion relative to the body 12 of the tool 10 by engaging the plunger 54 with a notch 45 in the spindle 25. This enables the head 40 to be turned manually relative to the spindle 25, allowing the stud 52 to be disengaged with the threaded bore 41 of the spindle 25, thereby removing the head 40 from the spindle 25.

The plunger 54 may be a separate component from the tool 10 that is inserted into the passage 47 only when it is desired to remove and replace the head 40 or the plunger 54 may be a component of the tool 10 that is mounted to the body 12 of the tool 10 as shown in FIGS. 3B and 3C.

In the depicted embodiment, the passage 47 is disposed in the shroud 28 and the plunger 54 is biased toward an unlocked position, that is, in a direction away from the primary axis 42 of the motor shaft 38. For example, in one embodiment, a spring 49 is disposed between the shroud 28 and a plunger shoulder 53 to bias the plunger 54 in the unlocked position. The plunger 54 also includes a snap ring 51 that prevents the spring 49 from dislodging the plunger 54 from the passage 47. In the unlocked position (FIG. 3B), the plunger 54 is adjacent to but not engaged with the passageway 71 in the motor shaft 38, such that the motor shaft 38 and the spindle 25 are free to rotate. In the locked position (FIG. 3C), the plunger 54 is extended through the passageway 71 of the motor shaft 38 and into the spindle notch 45, such that the motor shaft 38 and the spindle 25 are each prevented from rotating.

When it is desired to replace the head 40, the plunger 54 is depressed in the direction of the arrow 73 (FIG. 3B) while simultaneously turning the head 40 until the plunger 54 is aligned with and engages the passageway 71 of the motor shaft 38. When so aligned, depressing the plunger 54 allows the plunger to extend through the passageway 71 of the motor shaft 38 to a position adjacent to the spindle 25. In this position, the plunger 54 is depressed in the direction of the arrow 73 while simultaneously turning the head 40 until the plunger 54 is aligned with and engages the notch 45 in the spindle 25. When so aligned, depressing the plunger 54 allows the plunger to extend into the notch 45 in the spindle 25, thus locking both the spindle 25 and the motor shaft 38 against further rotation. With the plunger 54 in the locked position, the head 40 can be rotated while the spindle 25 remains stationary, thereby unscrewing the stud 52 from the threaded bore 50 of the spindle 25 until the head 40 is separated from the spindle 25. A new head 40 can then be installed by reversing the method described for removing the head 40 from the spindle 25.

The spindle locking structure described above enables quick and easy replacement of the head 40 without tools. Thus, the tool 10 can be used with different heads to perform, in effect, as a number of different tools.

With reference to FIG. 1 in more detail, compressed air is supplied to the motor 16 through a manually actuable valve 58. A separate air control valve 60 is rotatable within the body structure 12 for adjustment of the flow of pressurized air through the tool 10. In order to prevent the air control valve 60 from being ejected axially from the body structure 12, the air control valve 60 is held in place within the body structure 12 by a set screw 62. The set screw 62 can be a full dog Allen screw wherein the dog end tip engages a groove formed within the air control valve shank.

Figure 7:
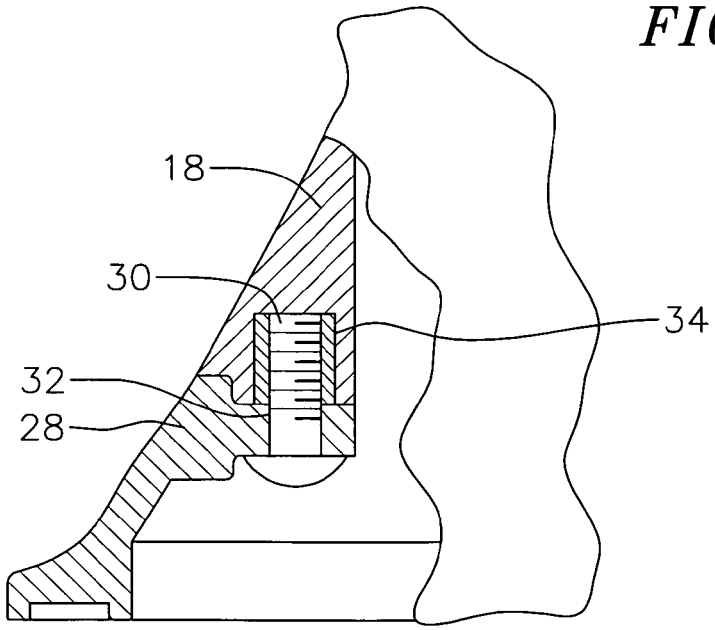
FIG. 7 is a fragmentary partial vertical cross-section view of the orbital sanding tool showing the connection between the body structure to the shroud at the location of one of the attachment screws.

It is desirable to make the hand-held orbital abrading or polishing tool 10 economical as well as light weight for easy handling. In order to achieve these goals, the body structure 12 is injection molded of a suitable synthetic polymeric material. For example, #6 nylon with 38% glass fiber can be used. As illustrated in FIG. 5, the polymeric main body section 18 is attached to the polymeric shroud or skirt 28 to form the body structure 12. The shroud 28 is formed separately from the main body section 18 so that the shroud 18 can be replaced easily for use with heads 40 of different sizes. The shroud 28 is secured to the main body section 18 by means of the three screws 30 extending upwardly through the holes 32 in the shroud 28 and into the tapped bores 34 of the main body section 18 (FIG. 7).

As illustrated in FIGS. 4 and 6, four lugs 20 are affixed to the corners of a metal plate 69 embedded within the top cover 22 of the body structure 12. The top cover 22 is secured to the main body section 18 by passing screws 24 upwardly through holes 25' in the top of the main body section 18 and fastening the screws into the lugs 20. Sheet metal nuts or other commercially available hardware can also be used so long as they have inside threads for matching with the threads on the outside of the screws 24. This method saves time and expense by requiring significantly less drilling and tapping than prior art methods in which a top cover is secured to a body structure utilizing screws passing downwardly through the top of the cover and into threaded bores in the body structure. Further, by passing the screws 24 upwardly into the lugs 20, the screws 24 can conveniently be used to support the motor 16 in the main body section 18 as shown in FIG. 6.

Figure 2:
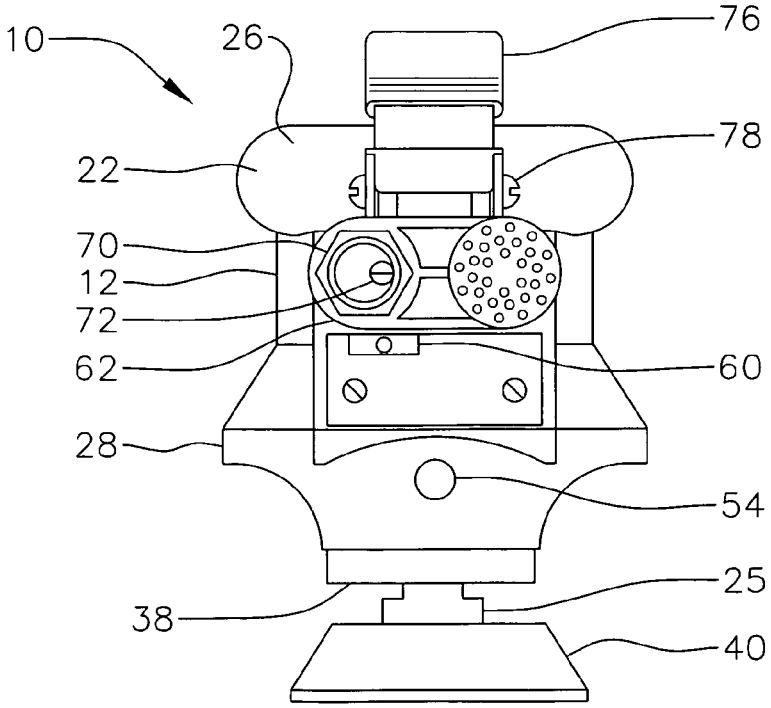
FIG. 2 is a rear elevational view of the orbital sanding tool of FIG. 1.

Referring to FIGS. 1 and 2, air is supplied to the motor 16 from a source of compressed air through a line connecting into a rearwardly projecting portion 70 of the body structure 12. From this inlet, air flows through a passage 72 in the portion 70 to a vertical bore containing the manually actuable valve 58. The valve 58 is normally spring urged to its closed position and is adapted to be opened by downward movement of an actuating handle 76 attached pivotally at 78 to the body structure 12. The air control valve 60 can be rotated to adjust the degree of alignment between the passage 72 and an entrance hole in the wall of the control valve 60. Greater alignment of the holes provides increased air flow while blockage of the passage 72 can shut off the air flow. Thus, depression of the handle 76 by an operator admits air from the passage 72 to a passage that leads to the motor 16, commencing operation of the motor and orbital movement of the head 40. Air discharged from the motor is exhausted to the atmosphere through an outlet passage.

For convenience, the above description has focused on using the tool 10 according to the present invention as a sanding tool. However, the present invention is not meant to be limited in use to sanding. Instead, it can be used for any sort of abrading or polishing by using abrading or polishing sheets or pads with the head 40. The head 40 itself can also be constructed to abrade or polish without any abrading or polishing sheets or pads attached.

While the above description contains many specific features of the invention, these should not be construed as limitations on the scope of the invention, but rather as an example of one preferred embodiment thereof. Many other variations are possible. Accordingly, the scope of the invention should be determined not by the embodiments illustrated, but by the appended claims and their legal equivalents.

What is claimed is:

1. An orbital abrading or polishing tool comprising:

a tool body to be held and manipulated by a user;

a motor carried by the tool body and having a motor shaft driven for rotation about a primary axis;

the motor shaft having a cylindrical portion at one end;

a spindle received within the cylindrical portion of the motor shaft for rotation about a secondary axis offset from and parallel to the primary axis;

the cylindrical portion of the motor shaft having an opening extending inwardly to the spindle; and a locking element extendable through said opening to engage the spindle in a locking relationship.

2. The tool of claim 1, wherein the locking element is extendable into a notch in the spindle when the notch is aligned with the motor shaft opening.

3. The tool of claim 1, wherein the locking element is a spring loaded plunger.

4. The tool of claim 1, wherein the tool body comprises a shroud having a passageway extending inwardly toward the spindle, and wherein the locking element is mounted to the shroud and moveable within said passageway.

5. The tool of claim 1, further comprising a head threadedly connected to said spindle and adapted to carry an element for abrading or polishing a work surface.

6. The tool of claim 1, wherein the spindle comprises a shaft and at least one bearing rotatably mounted to the spindle shaft.

7. The tool of claim 6, wherein the at least one bearing is received within the cylindrical portion of the motor shaft, allowing the spindle to rotate with respect to the motor shaft.

8. An orbital abrading or polishing tool comprising:

a tool body having a shroud, wherein the tool body is to be held and manipulated by a user;

a motor carried by the tool body and having a motor shaft driven for rotation about a primary axis;

the motor shaft having a cylindrical portion at one end;

a spindle received within the cylindrical portion of the motor shaft for rotation about a secondary axis offset from and parallel to the primary axis and driven in an orbital path about the primary axis when the motor turns the motor shaft;

the cylindrical portion of the motor shaft having an opening extending inwardly to the spindle;

a locking element extendable through said opening to engage the spindle in a locking relationship; and a head threadedly connected to said spindle and adapted to carry an element for abrading or polishing a work surface.

9. The tool of claim 8, wherein the spindle comprises a shaft and at least one bearing rotatably mounted to the spindle shaft.

10. The tool of claim 9, wherein the at least one bearing is received within the cylindrical portion of the motor shaft, allowing the spindle to rotate with respect to the motor shaft.

11. The tool of claim 9, wherein the shroud comprises a passageway that extends inwardly toward the spindle, and wherein the locking element is mounted to the shroud and moveable within said passageway.

12. The tool of claim 11, wherein the locking element is extendable into a notch in the spindle when the notch is aligned with the motor shaft opening.

13. The tool of claim 12, wherein the locking element is a spring loaded plunger that is biased radially outward from the tool body, such that in a resting position the plunger is disengaged from both the motor shaft opening and the spindle notch, allowing for a free rotation of both the motor shaft and the spindle.

14. A method for replacing a head of an orbital abrading or polishing tool comprising:

providing a motor that drives a motor shaft, wherein the motor shaft receives a spindle;

pressing on a locking element to contact the motor shaft;

manually rotating a first head that is threadedly connected to the spindle until the locking element enters an opening in the motor shaft that extends inwardly to the spindle;

pressing on the locking element to contact the spindle to lock the spindle against rotation;

manually rotating the first head while the spindle is locked against rotation until the first head is disengaged from the spindle;

positioning a second head relative to the spindle so that the second head can be rotated relative to the spindle to form a threaded connection therebetween;

manually rotating the second head to threadedly and tightly connect the second head with the spindle; and releasing the locking member to disengage the locking member from the both the spindle and the motor shaft opening to thereby allow the spindle and motor shaft to freely rotate.

15. The method of claim 14, further comprising manually rotating the first head until the motor shaft opening is aligned with a notch in the spindle and pressing on the locking element to engage the locking element with the notch in the spindle to lock the spindle against rotation.

* * * * *